US005828178A

United States Patent [19]

York et al.

[11] Patent Number: 5,828,178

[45] Date of Patent: Oct. 27, 1998

[54] HIGH INTENSITY DISCHARGE LAMP COLOR

[75] Inventors: Allan Brent York, Langley; Robert H. Maxwell, Alton, both of Canada

[73] Assignee: TIR Systems Ltd., Vancouver, Canada

[21] Appl. No.: 762,615

[22] Filed: Dec. 9, 1996

[51] Int. Cl.[6] ..... H05B 37/02; G05F 1/00

[52] U.S. Cl. ..... 315/151; 315/149; 315/152; 315/308; 315/312; 250/214 AG; 250/214 AL

[58] Field of Search ..... 315/158, 312, 315/308, 317, 149, 151, 152; 250/214 AG, 214 AL

[56] References Cited

U.S. PATENT DOCUMENTS

| | | | |
|---|---|---|---|
| 4,396,872 | 8/1983 | Nutter | 315/308 |
| 4,717,863 | 1/1988 | Zeiler | 315/307 |
| 4,874,989 | 10/1989 | Nilssen | 315/151 |
| 5,030,887 | 7/1991 | Guisinger | 315/158 |
| 5,225,742 | 7/1993 | Beasley | 315/307 |
| 5,323,090 | 6/1994 | Lestican | 315/291 |
| 5,410,220 | 4/1995 | von Hertzen | 315/209 R |
| 5,418,432 | 5/1995 | Takeuchi et al. | 315/151 |
| 5,461,285 | 10/1995 | Schleijpen et al. | 315/149 |

OTHER PUBLICATIONS

Rath, "HID Dimming Systems", Lighting Magazine, p. 18, Feb., 1996.

*Primary Examiner*—Arnold Kinkead
*Attorney, Agent, or Firm*—Oyen Wiggs Green & Mutala

[57] ABSTRACT

Apparatus for monitoring and controlling the operation of one or more high intensity discharge (HID) lamps. An electronic HID lamp power supply is electrically connected to a power source and to the HID lamps. For each lamp, one or more sensors produce one or more output signals respectively representative of one or more parameters (such as light intensity, color temperature, power consumption, temperature, arc voltage, etc.) which respectively define one or more operational characteristics of the lamps. A programmable controller receives the sensors' output signals and programmatically responds by, for example, outputting to the power supply control signals for controlling operation of the lamps to cause a selected variation in a selected one or more of the sensed parameters, and/or by periodically logging information characteristic of an operational state of one or more of the lamps or the power supply at a selected time or times, and/or by producing diagnostic information characteristic of an operational state of one or more of said lamps or said power supply.

1 Claim, 12 Drawing Sheets

| Fatal Error Type | Recovery? | Resume? |
|---|---|---|
| EPROM checksum bad | yes | yes |
| EEPROM checksum bad | yes | yes |
| Illegal Opcode | yes | no |
| Bad CONFIG register | yes | no |
| RAM test failed | yes | no |
| Stack Overrun | no | no |
| EEPROM verify fail | no | no |

HIGH INTENSITY DISCHARGE LAMP COLOR

FIELD OF THE INVENTION

This application pertains to apparatus for monitoring and controlling the operation of one or more high intensity discharge lamps; and, in particular, to apparatus for controlling colour temperature variation between individual high intensity discharge lamps operated adjacent one another under similar conditions.

BACKGROUND OF THE INVENTION

High intensity discharge ("HID") lamps have a number of useful characteristics, including high intensity, long life and efficiency. These characteristics make HID lamps desirable in industrial, architectural or street lighting applications. Magnetic ballasts are typically used to drive HID lamps, which require high current electrical discharge at relatively high pressures.

Recently, luminaires have been developed for high quality commercial applications such as retail and office space where efficiency, high colour rendering and high intensity are sought. HID lamps such as metal halide lamps are well suited to use in such applications. But, problems can arise if several HID lamps are located adjacent one another in a luminaire of this sort. In particular, significant colour variations between adjacent lamps are often readily apparent to persons observing such luminaires. These variations detract from the overall aesthetic quality of the illumination provided by the luminaire.

The primary factor responsible for such colour variation is the fact that metal halide lamps utilize a mixture of metal halide salts to produce "white" light. If adjacent lamps do not have precisely the same mixture of metal halide salts, then colour variations will be apparent when the lamps are operated adjacent one another under identical conditions. Furthermore, if the magnetic ballasts which drive the HID lamps are built to relatively low tolerances, or exhibit significant output variations with changing input voltages, then perceptible variations will occur in the light output by the lamps. In combination, these factors can result in colour variations of ±400 degrees Kelvin relative to a nominal correlated colour temperature, in a large installation.

Colour variations between different HID lamps can also be exaggerated if lamps are replaced individually as they age, because HID lamps tend to lose more of some metal halide salts than others as they age. Accordingly, colour variations between new and old HID lamps are generally readily apparent if the lamps are operated adjacent one another under similar conditions.

It can thus be seen that there is a need for a means of controlling colour variation between HID lamps operated under similar conditions. Lamp manufacturers have addressed the problem by developing low wattage (35 to 150 watt) metal halide lamps having ceramic arc tubes which are significantly less prone to colour variation. Colour variations of no more than about ±50 degrees Kelvin between different lamps are typically claimed for such lamps. Some electronic ballast manufacturers have also developed compact, low frequency, electronic ballasts designed to operate the new low wattage lamps within tight tolerances. However, these lamps are unsuitable for many applications, since they are only available in low wattages (i.e. up to 150 watts) providing colour temperatures of up to about 3000 degrees Kelvin. Most industrial, architectural or street lighting applications require significantly higher wattages and colour temperatures.

This invention addresses the HID lamp colour variation problem by providing an HID lamp controller capable of closely matching colour temperatures in a large population of HID lamps. Individual HID lamps can be remotely controlled to switch lamps on or off, dim selected lamps, etc. The output of each lamp can be accurately regulated throughout the lamp's life. The HID lamp controller can also be used to gather data which can be used to remotely diagnose lamp or luminaire problems.

SUMMARY OF THE INVENTION

In accordance with the preferred embodiment, and in general, the invention provides an apparatus for monitoring and controlling the operation of one or more HID lamps. An electronic HID lamp power supply is electrically connected to a power source and to the HID lamps. For each lamp, one or more sensors produce one or more output signals respectively representative of one or more parameters (such as light intensity, colour temperature, power consumption, temperature, arc voltage, etc.) which respectively define one or more operational characteristics of the lamps. A programmable controller receives the sensors' output signals and programmatically responds by, for example, outputting to the power supply control signals for controlling operation of the lamps to cause a selected variation in a selected one or more of the sensed parameters, and/or by periodically logging information characteristic of an operational state of one or more of the lamps or the power supply at a selected time or times, and/or by producing diagnostic information characteristic of an operational state of one or more of said lamps or said power supply.

The invention also provides a colour temperature photosensor having first and second photodiodes. A colour filter is placed between one of the photodiodes and an adjacent HID lamp. A colour signal feedback means produces the photosensor's output signal (i.e. a signal representative of colour temperature change in the adjacent HID lamp). The colour signal feedback means has first and second variable gain amplifiers which are electrically connected to the first and second photodiodes respectively. The first amplifier receives signals (output by one of the photodiodes) representative of light intensity output by the adjacent HID lamp. The second amplifier receives signals (output by the other, i.e. the colour filtered photodiode) representative of colour temperature of light output by the lamp. A comparator receives the signals output by one of the amplifiers, compares those signals with a reference signal, and outputs a corresponding gain control signal to each amplifier.

BRIEF DESCRIPTION OF THE DRAWINGS

FIG. 4(*a*) depicts the initialization and main command sequences; FIG. 4(*b*) depicts the master interrupt service routine for the Pulse-Width Modulated (PWM) analog output channels; FIG. 4(*c*) depicts the interrupt service routines for the individual PWM channels; FIG. 4(*d*) depicts the routine which sets the PWM output values; FIG. 4(*e*) depicts the routine which processes user input commands; and, FIG. 4(*f*) depicts the procedure followed on detection of a "Fatal Error".

DETAILED DESCRIPTION OF THE PREFERRED EMBODIMENT

I. Introduction

Figure 1:
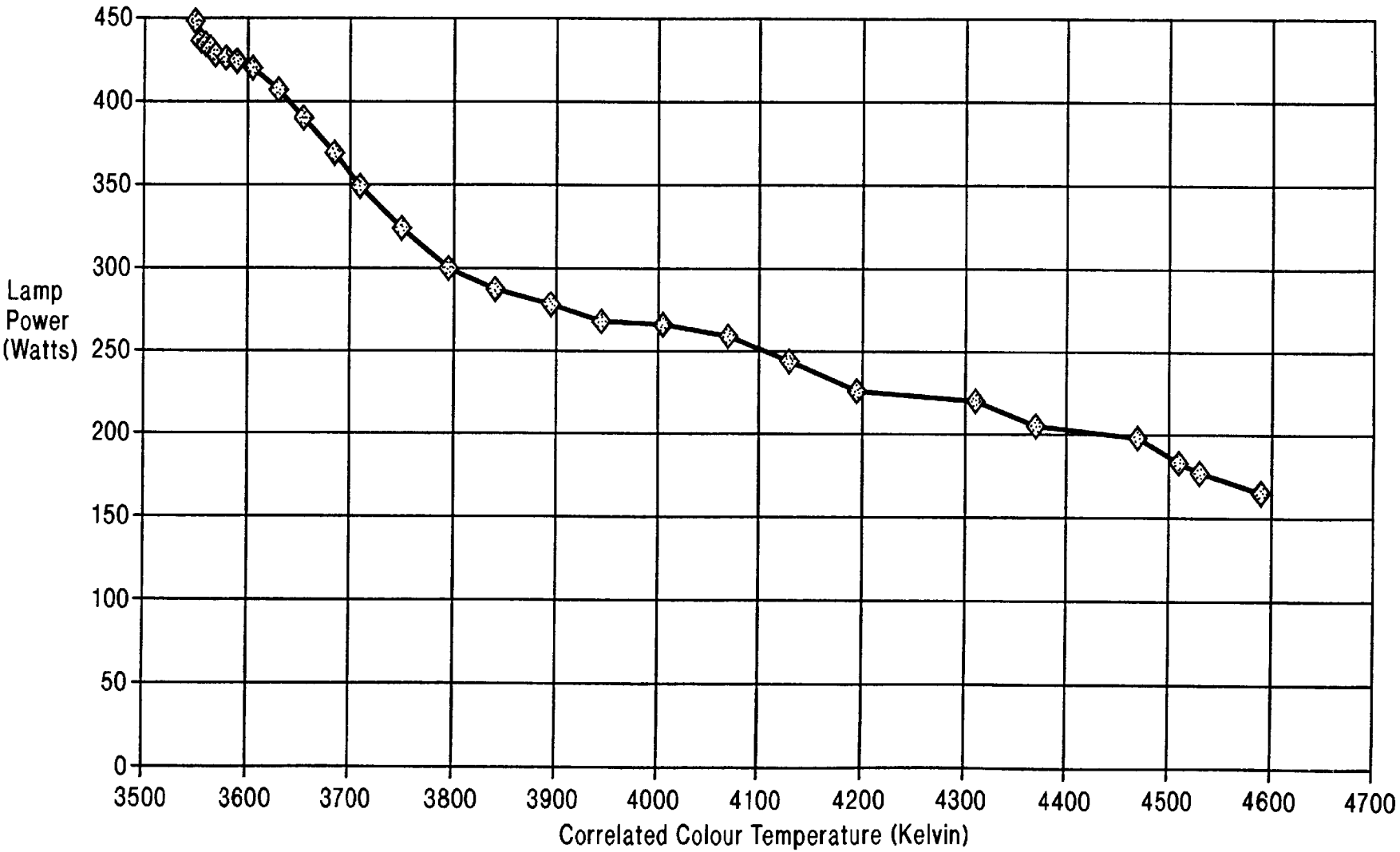
FIG. 1 is a graph on which HID lamp drive voltage is plotted as a function of lamp colour temperature.

As shown in FIG. 1, a HID metal halide lamp driven by a typical prior art high frequency electronic ballast exhibits a colour temperature variation which is roughly inversely proportional to lamp wattage (lamp wattage increases as lamp drive voltage decreases). In general, as wattage increases, HID metal halide lamp colour temperature decreases.

The present invention utilizes this principle to achieve a colour match amongst a population of HID lamps by individually controlling the wattage of each lamp within an acceptable operating range. Within a range of operation of about 90% to 110% of nominal wattage, there is a corresponding range of colour temperature which permits the matching of a large population of lamps. As current is added to the arc of an HID lamp having a typical sodium/scandium chemistry, there is a tendency for the lamp's colour temperature to continue dropping. For a lamp having a colour temperature rating of say 4000 degrees Kelvin, there is an upper range of operation at which, if the lamp is driven to perhaps 110% of nominal power, the corresponding correlated colour temperature drops by about 225 degrees Kelvin; and, if power is reduced to 90%, the correlated colour temperature rises by about 225 degrees Kelvin. This makes it possible to compensate for colour temperature variations in many lamps within a lamp population around some median value of perhaps 4000 degrees Kelvin by correspondingly increasing or decreasing power to individual lamps as required. Thus, it is possible to force each lamp's output into a satisfactory range around a mean value of correlated colour temperature by suitably controlling each lamp's power level.

A further aspect of the invention facilitates individual control of the power supply for each HID lamp in an installation consisting of a number (possibly hundreds) of HID lamps. This in turn enables remote control (dimming, adjustment, on/off switching, etc.) of individual lamps throughout the installation. Active photosensor feedback for each lamp facilitates accurate regulation of light output throughout the life of each lamp and, in conjunction with electronic power supply parameter monitoring, can yield data for remote diagnosis of individual lamp or luminaire problems in the field.

Figure 2:
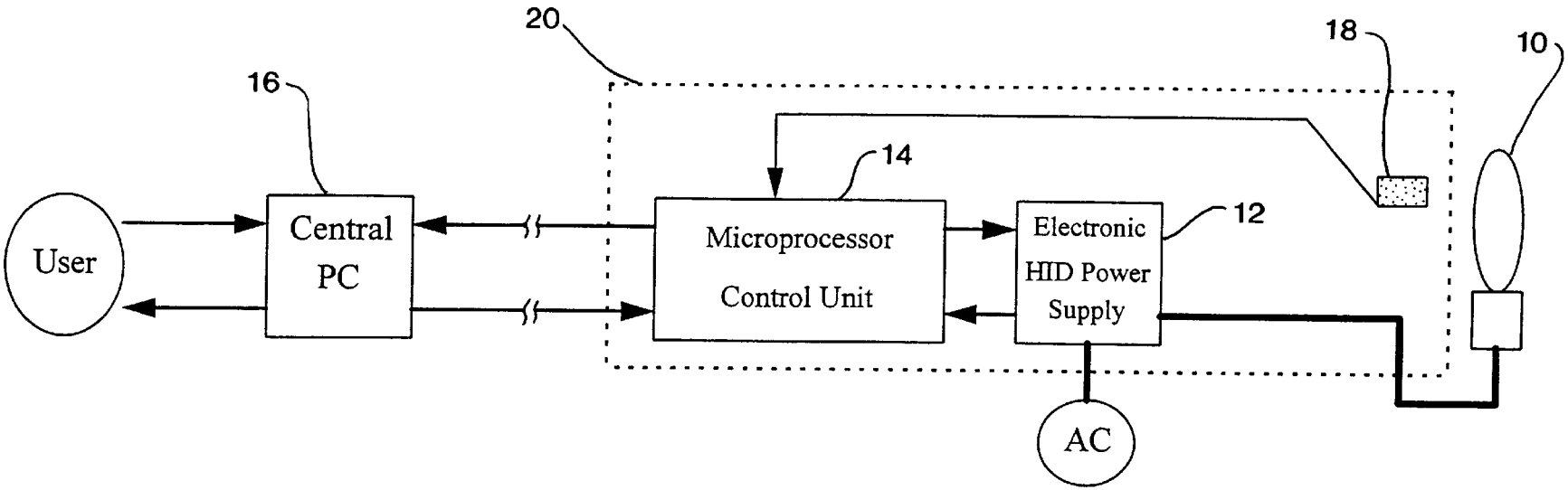
FIG. 2 block diagram of an HID lamp controller incorporating an electronic power supply, a microprocessor control unit and a feedback sensor in accordance with the invention.

FIG. 2 depicts components of the invention in block diagram form, in an operating context which includes an HID lamp 10 driven by high wattage electronic HID lamp power supply 12 (which may be a Delta Power "MH400W-Dimmable-HPF" ballast, model no. DBW-AVHM59-400W). Microprocessor control unit 14 is electronically coupled to power supply 12 and may also be coupled to a personal computer ("PC") 16 which serves as an operator's console. Photosensor feedback unit 18 is mounted closely proximate HID lamp 10 and is electronically coupled to microprocessor control unit 14. Power supply 12, microprocessor control unit 14 and photosensor feedback unit 18 collectively comprise an HID lamp controller 20, designated by dotted outline 20.

II. Microprocessor Ballast Control—Introduction

The prior art reveals a variety of electronic HID lamp ballasts which provide some form of light regulation through feedback or remote dimming capability. For example, such ballasts are often capable of being controlled by a feedback photoresistor mounted adjacent the HID lamp. In some cases, an adjustable voltage control is provided by which the user may remotely control lamp output.

By contrast, microprocessor control unit 14 is capable of monitoring and controlling a wide range of lamp and electronic ballast characteristics. Most high frequency electronic ballasts are susceptible to automated control, since the parameters affecting the output current and wattage of an HID lamp are easily controlled via the ballast's semiconductor output stages. However, conventional magnetic ballasts are susceptible to only very limited control, due to the invariant nature of their inductive and capacitive components. Furthermore, it is much easier to obtain HID lamp operating parameters for diagnostic purposes with an electronic ballast, since electronic signals representative of such parameters are often directly available at relatively low voltages on an existing circuit board. This in turn facilitates customized operation of HID lamps via access to the electronic ballast itself. Thus, parameters such as run-up time, restrike voltage management, lamp parking at low wattage, emergency power operation, and lamp voltage rise monitoring (a predictor of possible violent end of life in metal halide lamps) can all be monitored with the aid of microprocessor control unit 14.

An installation consisting of a number (possibly hundreds) of HID lamps may be controlled via software running on PC 16. Each HID lamp is assigned a unique "address" and coupled to a separate HID lamp controller 20 by suitable switching means in well known fashion. Each microprocessor control unit 14 is capable of controlling a single lamp and/or retrieving information characterizing the operation of a single lamp. Alternatively, lamps may be grouped in any desired combinations and a single microprocessor control unit 14 used to simultaneously control operation of or retrieve information characterizing operation of the group.

Microprocessor control unit 14 is capable of responding to a wide variety of inputs. As mentioned above, prior art ballasts are commonly used in conjunction with simple light level feedback or dimming control circuits. A typical prior art light level feedback circuit provides a "set and hold" type of control, which attempts to regulate the absolute light output of the lamp. Remote polling of the lamp is limited to a binary "All's Well" signal, which turns off if the lamp can no longer be regulated by the ballast. Prior art dimming circuits commonly employ an adjustable 0–10 volt source coupled to the control lead of the electronic ballast. Microprocessor control unit 14 provides all of the functionality inherent in prior art light level feedback or dimming control circuits, but is further capable of receiving and intelligently responding to other inputs. For example, four distinct operational modes are provided: open loop mode, analog mode, digital mode and mixed digital/analog mode.

In open loop mode, microprocessor control unit 14 outputs a user-defined voltage level to electronic HID lamp power supply 12. This is akin to a dimming function, by which the user can manually control the output (without feedback) of microprocessor control unit 14 to apply a desired voltage signal to electronic HID lamp power supply 12, causing it to respond by for example lowering the current to the lamp and thus "dimming" the lamp as the applied voltage rises. The operator may utilize software running on PC 16 to control HID lamps individually or in groups, for example to dim the lamp(s). No feedback is utilized in this mode, but lamp wattage is reasonably well regulated by the electronic ballast.

Figure 3A:
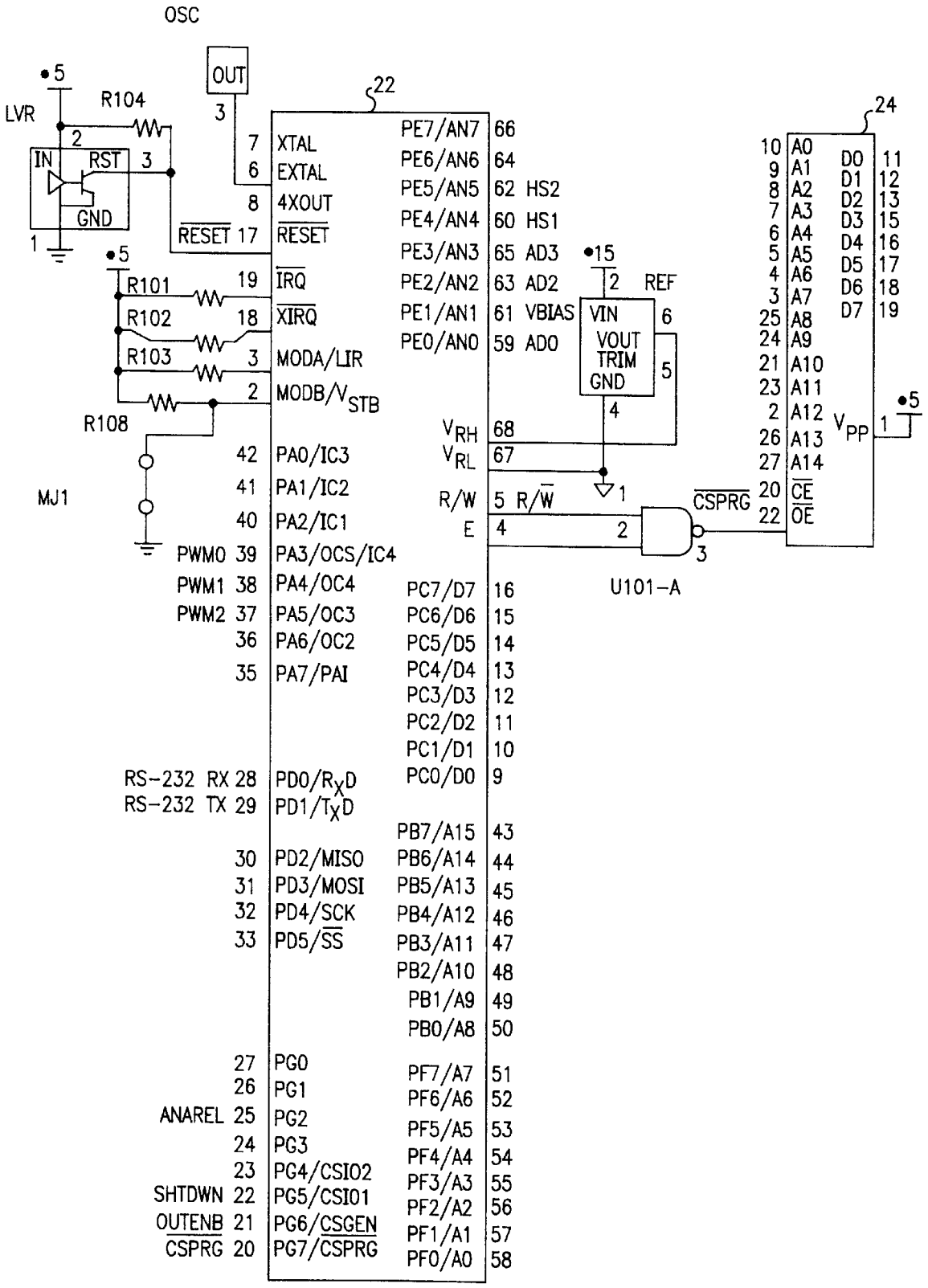
FIGS. 3(*a*), 3(*b*) and 3(*c*) are electronic circuit schematic diagrams of the microprocessor control unit.
Figure 3B:
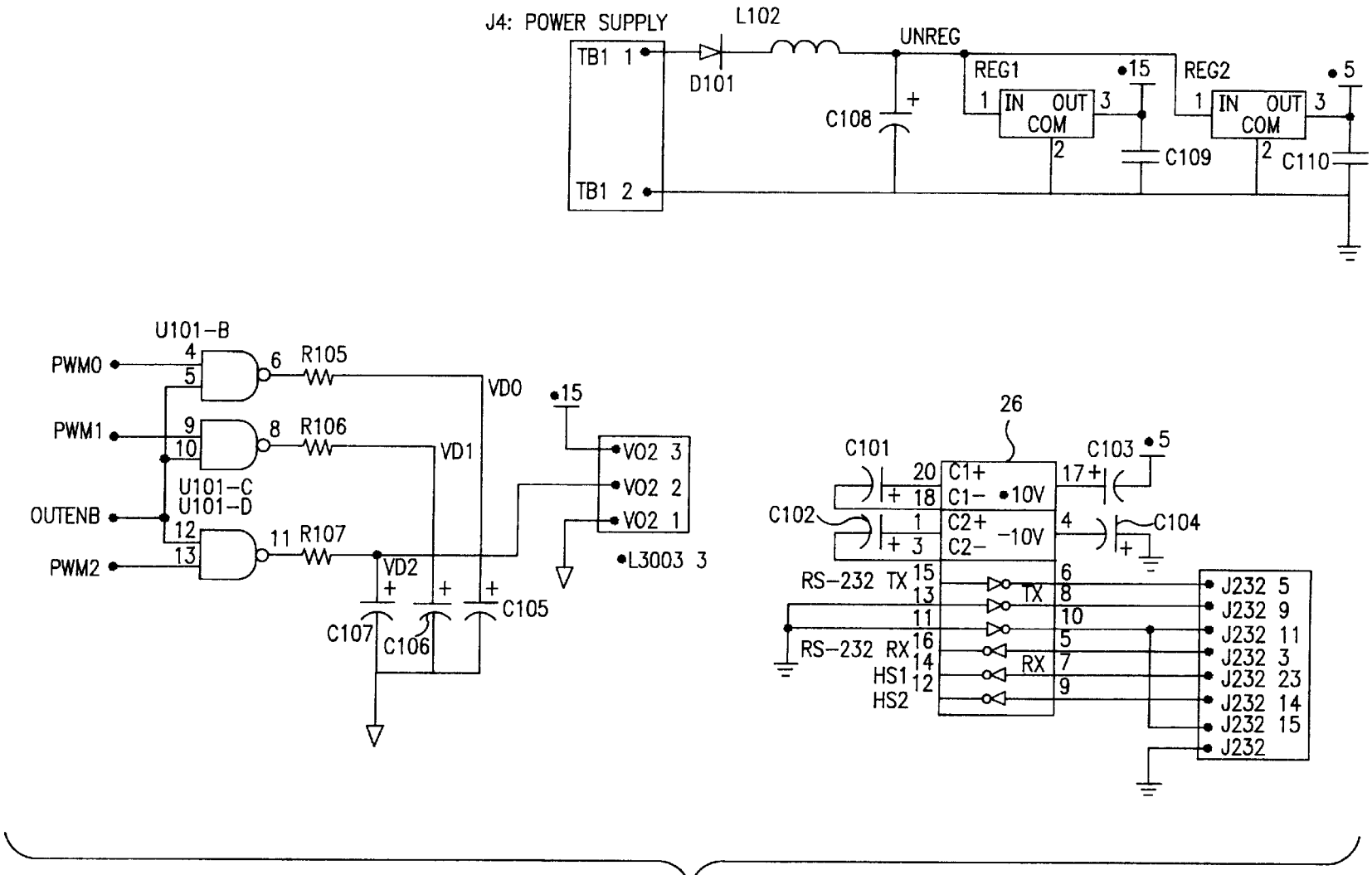
Figure 3C:
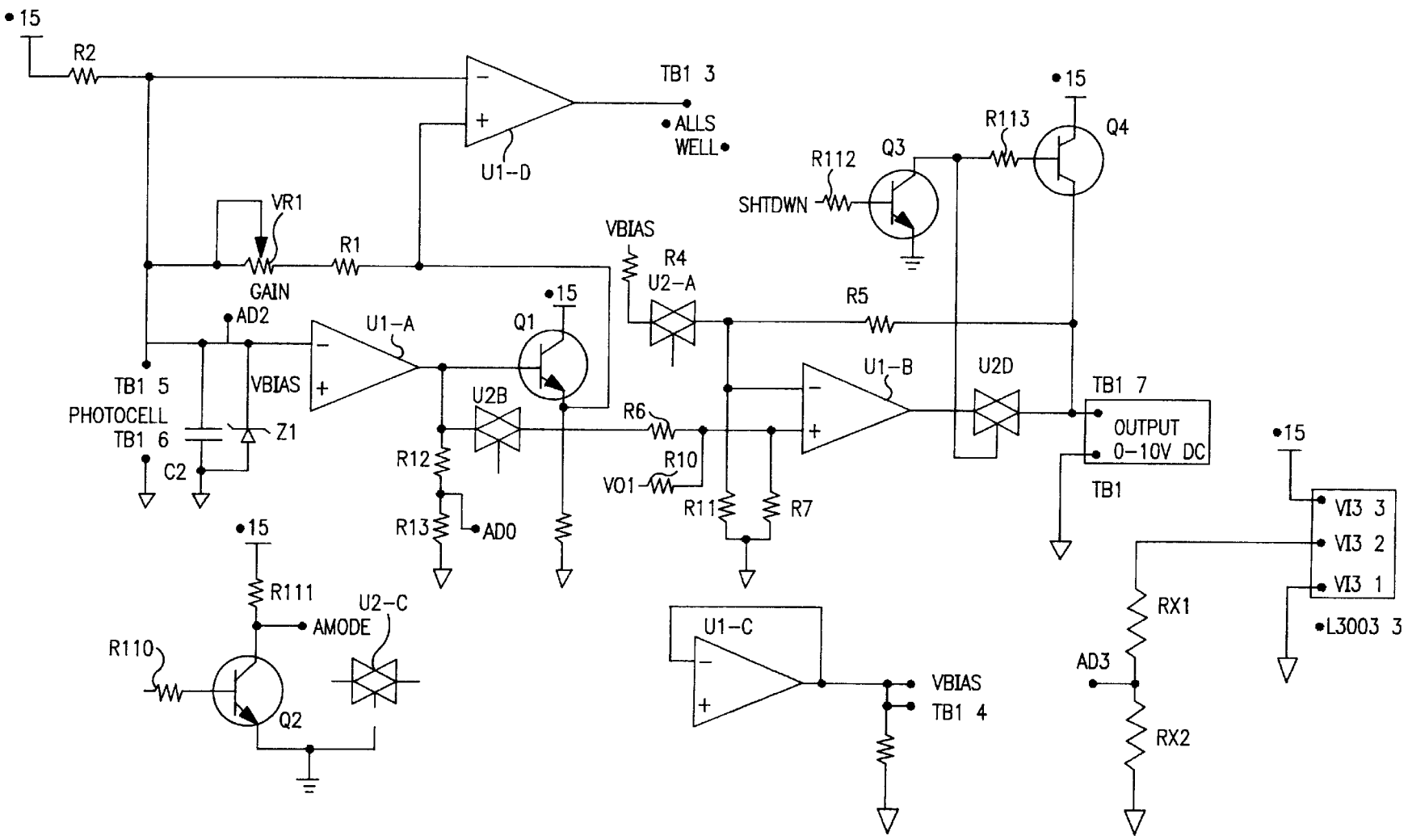
Figure 4A:
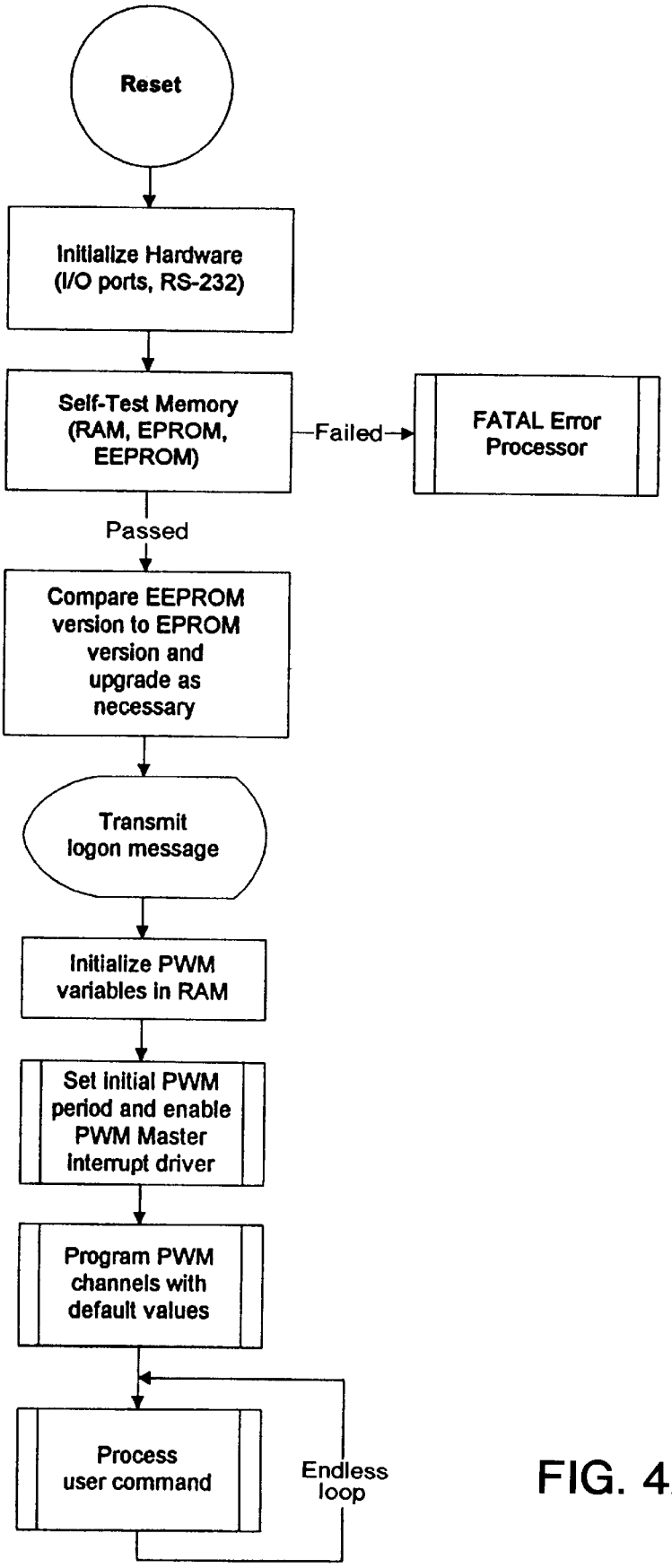
FIGS. 4(*a*) through 4 (*f*) are flowcharts which illustrate the sequence of steps performed by software which programmably controls operation of the microprocessor control unit.
Figure 4B:
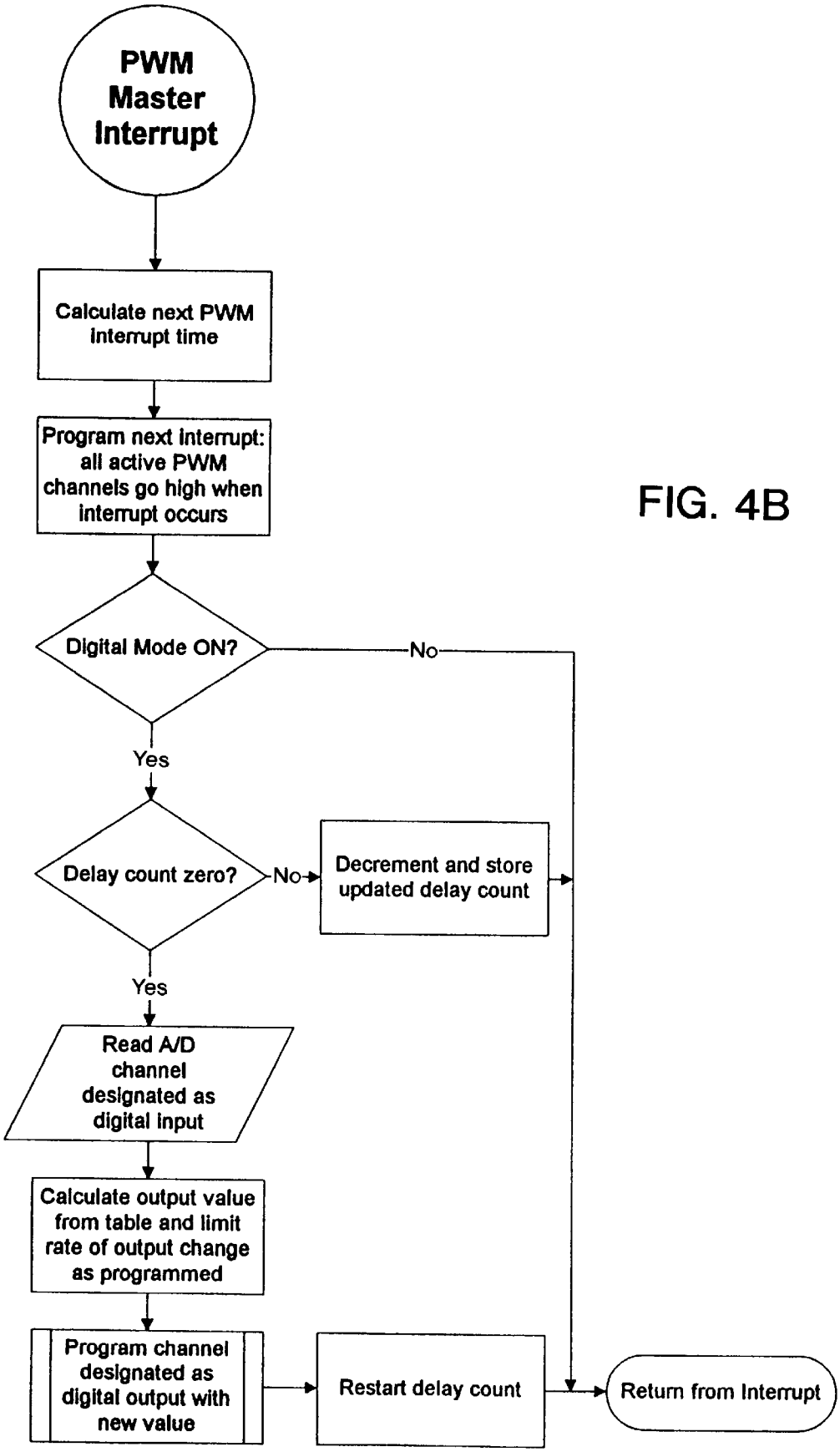
Figure 4C:
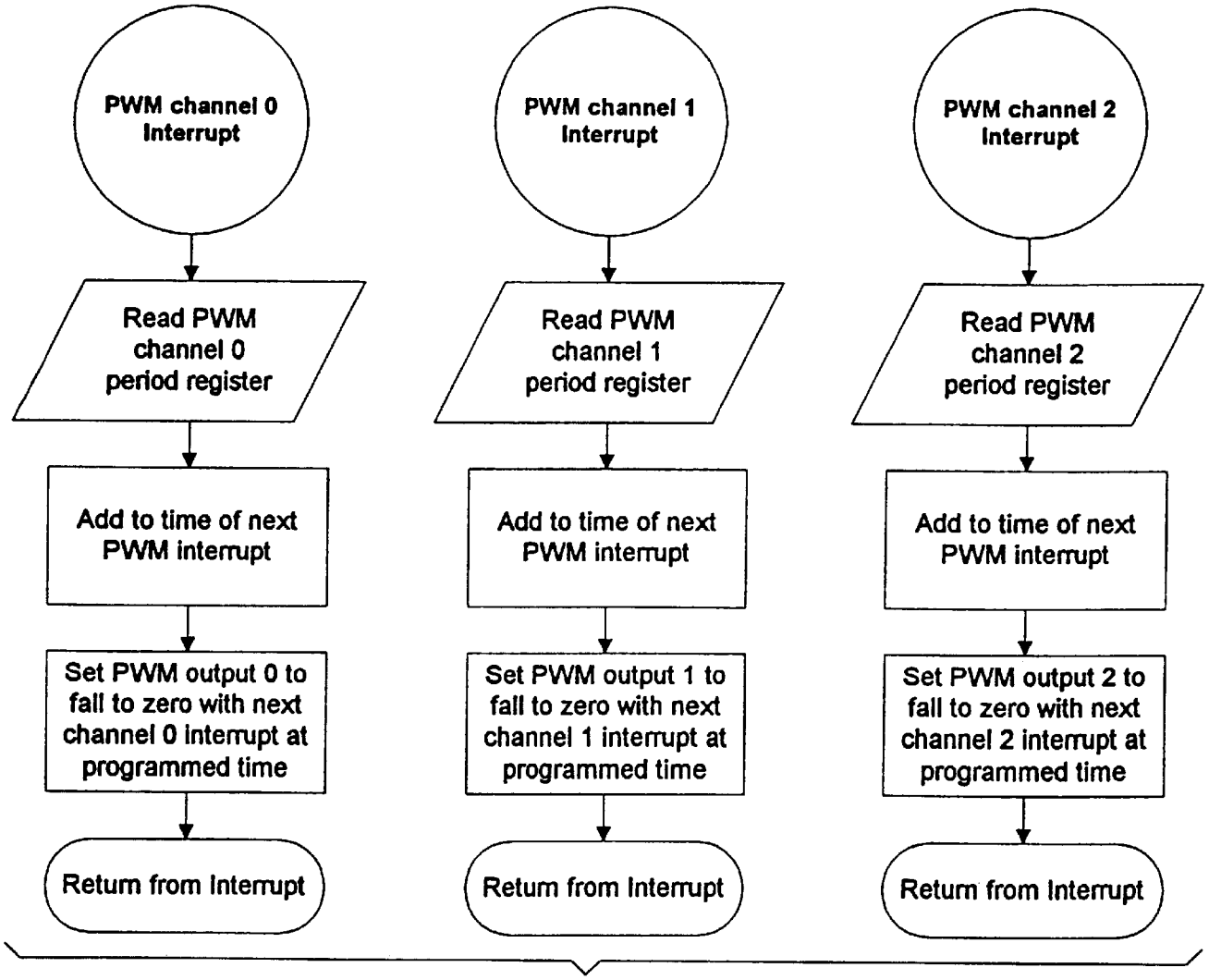
Figure 4D:
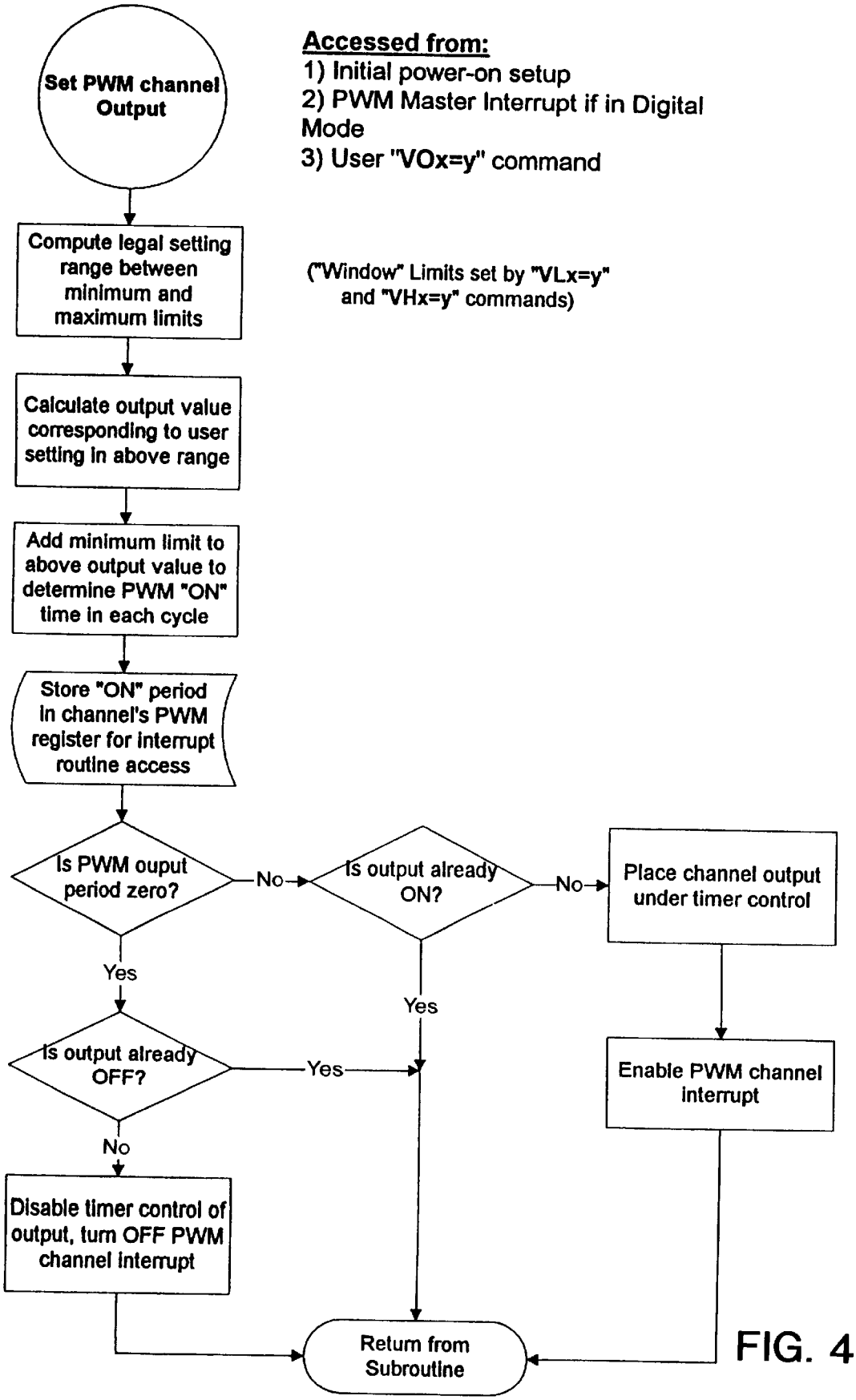
Figure 4E:
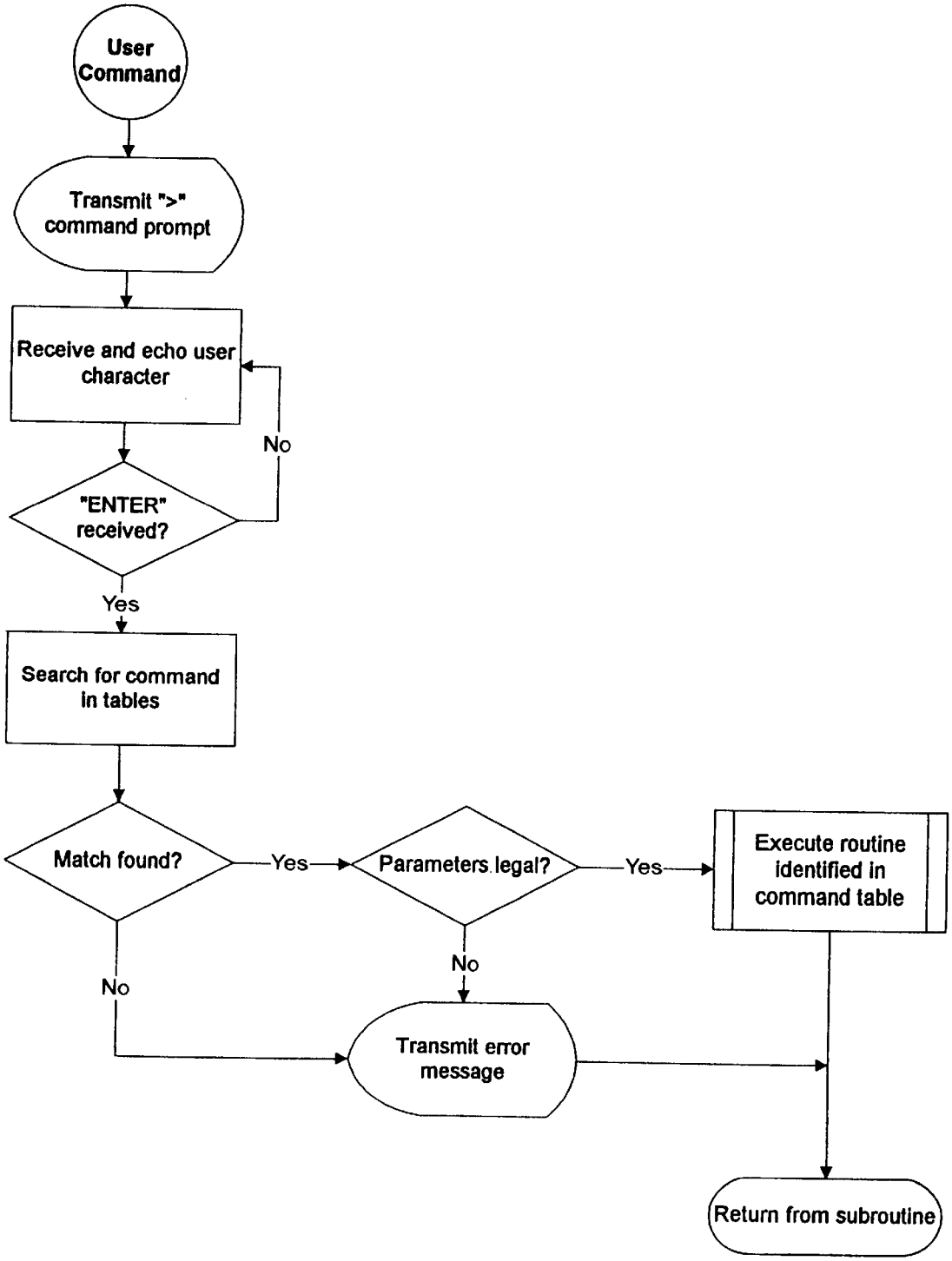
Figure 4F:
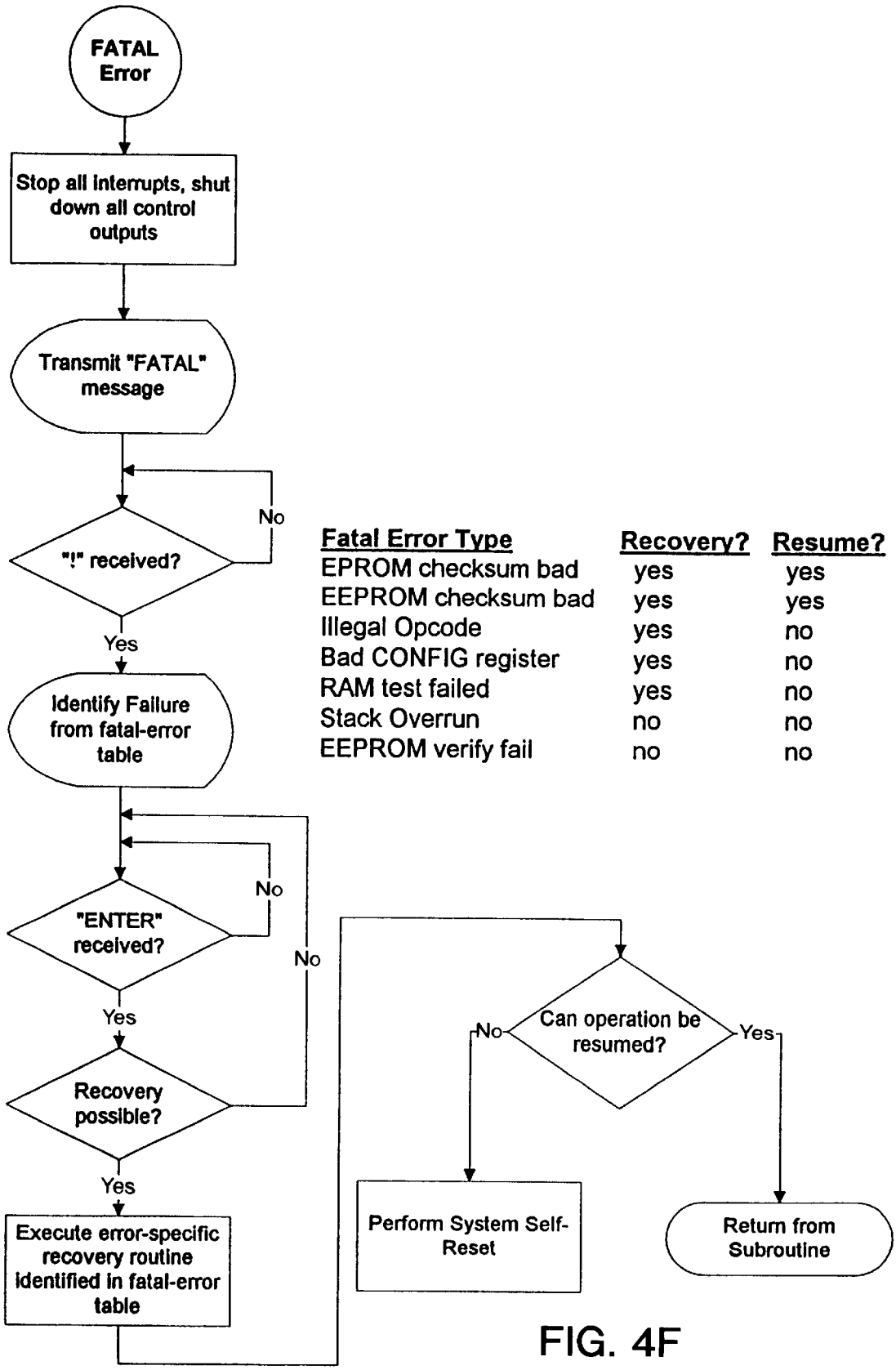

In analog mode, microprocessor control unit 14 utilizes an on-board analog light level feedback circuit (FIG. 3(*c*)) to apply a regulating output voltage to electronic HID lamp power supply 12. In this case, sensor 18 operates as a broadband photosensor responsive to bulk light output. If the overall light level drifts, the feedback circuit produces a corresponding control voltage to bring the light level back into regulation. The operator may adjust and set the output of lamp 10 by selecting a digital bias voltage which is used by the feedback circuit as a regulation point for the light source. A diagnostic function can be provided to simultaneously track the lamp's performance. If the lamp drifts out of regulation, goes out completely, or appears to be experiencing a rapid voltage rise (indicative that the lamp is nearing the end of its life) then an alarm and/or message can be sent to PC 16 recommending appropriate corrective action.

Figure 5:
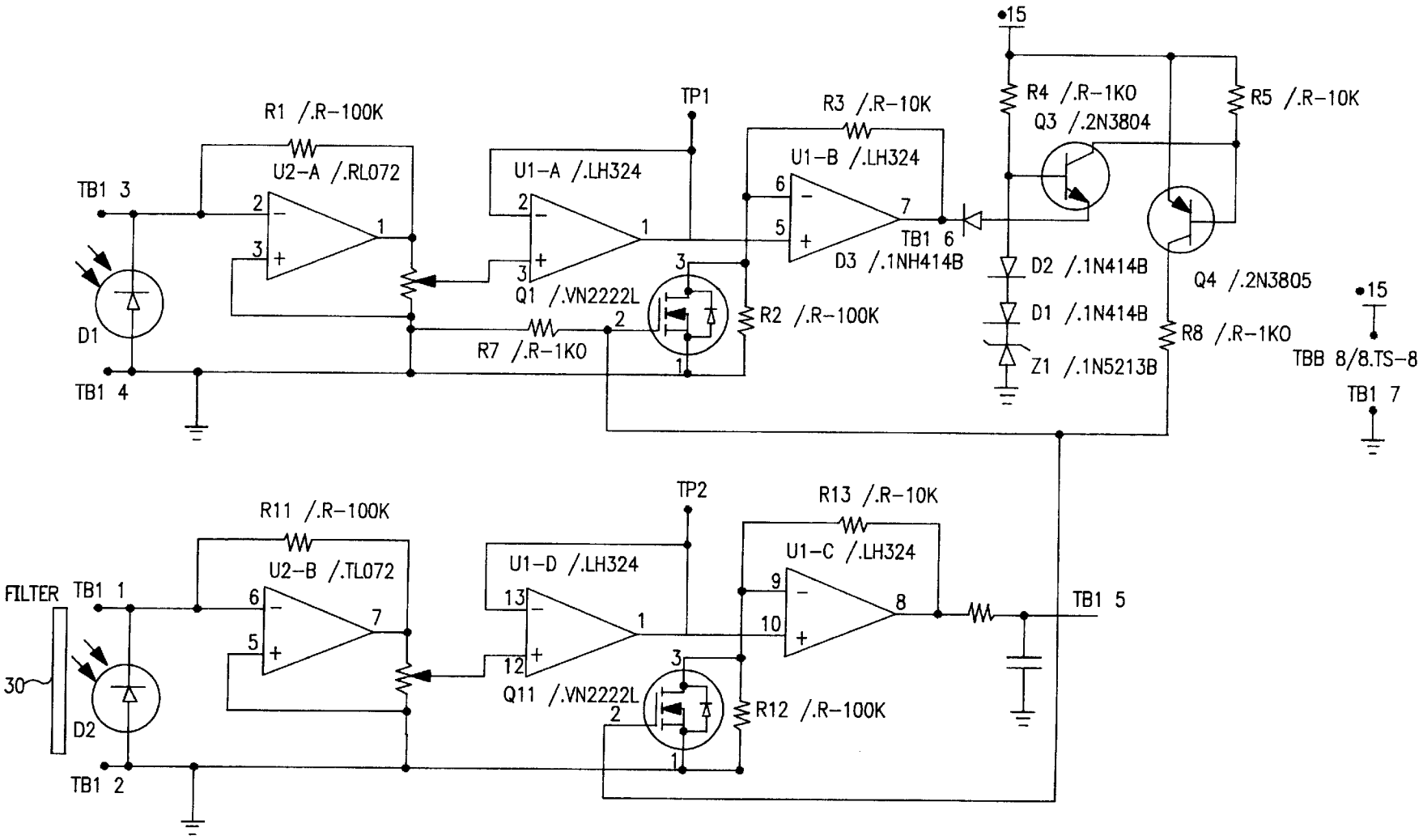
FIG. 5 is an electronic circuit schematic diagram of a colour photosensor circuit for use in the HID lamp controller of FIG. 2.

In digital mode, microprocessor control unit 14 retrieves information characterizing lamp operation from a selected input channel (which may address an individual lamp, or a group of lamps) and sends a response signal defined by a user-supplied set point and/or look-up table stored within microprocessor control unit 14. This enables microprocessor control unit 14 to respond non-linearly to non-linear inputs such as signals obtained from a dual element colour sensor (FIG. 5). In the simplest digital mode, microprocessor control unit 14 responds in a manner identical to that described above in relation to the analog mode by retrieving an output signal from photosensor feedback unit 18 and outputting a corresponding control voltage signal to bring lamp 10 back into regulation. More complex operation may require microprocessor control unit 14 to retrieve highly non-linear output signals from a colour sensor (FIG. 5) and output a control signal to electronic HID lamp power supply 12 in order to regulate the balance between two parts of the visible spectrum.

In mixed digital/analog mode, microprocessor control unit 14 combines the operational characteristics discussed above for the analog and digital modes respectively. In particular, control signals produced by microprocessor control unit 14 while operating in response to the same input signal in both analog and digital modes are averaged to provide a single control signal for output to electronic HID lamp power supply 12. Mixed digital/analog mode may be useful if selective damping of response or other effects are desired. For example this mode could be used to implement a type of "fuzzy logic" to balance requirements for colour stability with output stability.

The construction and operation of microprocessor control unit 14 will now be described in more detail.

III. Microprocessor Ballast Control—Operation

As depicted in FIG. 3(*a*), microprocessor control unit 14 incorporates integrated circuit microprocessor 22 (which may be a Motorola MC68HC11F1FN or MC68HC11F1CFN3 operated in expanded non-multiplexed mode). Microprocessor 22's memory requirements are satisfied by 32K byte EPROM 24 (which may be an 27C256 integrated circuit) together with an additional 512 bytes of EEPROM memory and 1K byte of RAM memory on microprocessor 22 itself.

In addition to the above memory resources, microprocessor 22 incorporates a multi-channel analog-to-digital (A/D) converter and a programmable hardware timer. The former continuously scans four analog inputs, while the latter provides three Pulse-Width Modulated (PWM) analog outputs, as follows:

| Channel | A/D Input | PWM (D/A) Output |
|---|---|---|
| 0 | Analog lamp drive | Bias |
| 1 | Bias | Digital lamp drive |
| 2 | Photosensor | VO2 aonnector |
| 3 | VI3 connector | (not available) |

The PWM output channels are numbered from 0 to 2, and are buffered by gates U101-B, U101-C and U101-D (FIG. 3(*b*)) and filtered into analog voltages by resistors R105-7 and capacitors C105-7. All analog channels operate within a range of 0 to ±5 volts DC, with an input/output value of 0 corresponding to 0 volts. On the inputs, a full-scale value of 255 corresponds to +5.00 volts; the output PWMs reach +4.80 volts with a full-scale output value of 255.

Microprocessor control unit 14 attempts to maintain a fixed bias voltage across photosensor unit 18. As the photosensor's resistance drops with increasing light levels, more current is required to maintain bias. This current is converted into a voltage signal by resistor R1 and variable resistor VR1 (FIG. 3(*c*)). The voltage signal is output to control the HID lamp adjacent photosensor unit 18. If the lamp reduces output when its input control voltage increases, the circuit acts as part of a feedback loop and regulates the HID lamp's light output.

In the "analog" mode mentioned above, microprocessor control unit 14 operates as described in the preceding paragraph, except that the bias voltage applied to photosensor unit 18 is determined by software as described below, thereby facilitating adjustment of the circuit's sensitivity. The bias, photosensor and analog drive voltages can each be monitored. Accordingly, microprocessor control unit 14 is capable of providing more detailed diagnostic information than the simple "All's Well" signal provided by prior art controllers.

For example, lamp arc voltage is an important operating parameter for HID lamps, which often undergoes dramatic changes when lamps are approaching end of life. When a lamp is first installed, the arc voltage varies somewhat, but typically stabilizes after approximately 100 hours and then remains fairly constant for a long period of time (10,000 to 20,000 hours). However, a sharp upward gradient in lamp arc voltage can rapidly approach the limits of the power supply, can cause cycling (as in high pressure sodium systems), and can be indicative of the lamp's imminent end of life. By monitoring lamp arc voltage, one may detect such gradients and take appropriate action such as notifying an operator that corrective action is required, or shutting down the power supply to potentially avert violent end of life in a metal halide lamp. Violent end of life is not usually hazardous, since modern HID luminaires are designed to contain the fragments of an explosion. However, luminaire maintenance can be awkward if the lamp explodes, since it is difficult to extricate the lamp base from the socket after the bulb has shattered.

As another example, lamp power is a useful measure of energy consumption and potential cost savings. By jointly monitoring lamp arc current and voltage, microprocessor control unit 14 may easily derive the instantaneous lamp power value and make that value available to PC 16 for appropriate user-defined action. Furthermore, lamp efficacy (the measure of light output per watt) can be inferred from a combination of the lamp power and the photosensor response. Such parameters may be useful to certain users who may wish to change lamps before they become too inefficient.

A digitally-generated voltage output signal obtained from PWM channel 1 is added to the analog control voltage output at the summing junction formed where R6, R7 and R10 connect to amplifier U1-B. The analog voltage can be removed by turning off analog switch U2-B. The value of the voltage sourced by PWM channel 1 can be specified by user command, or can be generated by the "Digital I/O Table," a 256-entry lookup table located in microprocessor 22's RAM memory.

The Digital I/O Table allows the user to specify any desired output value to correspond to each of the 256 possible readout states of one of the four A/D input channels. Any A/D input channel may be specified as table input. The table output value may be directed to one of the three PWM output channels. Normally, table output is directed to PWM channel 1 or turned off, since neither the bias voltage on PWM channel 0 nor the unassigned PWM channel 2 voltage require I/O Table control. The analog photosensor voltage from amplifier U1-A, switched by U2-B is algebraically summed by amplifier U1-B with the digitally-generated voltage from PWM channel 1, and the two sources can be combined in four ways:

In analog feedback mode, U2-B is switched on while PWM channel 1 is held at zero;

In digital feedback mode, U2-B is off, and PWM channel 1 becomes the sole source of output voltage, controlled by the digital I/O table;

Mixed analog and digital mode has U2-B on and PWM channel 1 under digital I/O table control;

Open-loop digital mode has U2-B off and PWM channel 1 generating a fixed voltage under command (as opposed to I/O table) control.

Incoming software commands are received by an RS-232 buffer 27 (FIG. 3(*b*)) and converted to safe logic voltages for transmission to microprocessor 22's RS-232 input port. Responses are transmitted from microprocessor 22's RS-232 output port to buffer 27, which shifts the signals to the appropriate voltages for RS-232. As depicted in FIG. 4(*e*), keyboard commands are accepted when the system displays a ">" prompt on the display screen of PC 16, and the command is executed when the RETURN (or ENTER) key is pressed. Only the Backspace (or CTRL-H) control character is recognized: deletes the character immediately preceding the cursor. Input is case-insensitive, since all lower case characters are automatically converted to capitals.

IV. Software Commands

A. Output Control

The "ON" and "OFF" commands control the voltage applied to lamp 10. The OFF command disconnects the output of summing amplifier U1-B (FIG. 3(*c*)) from the lamp control voltage output, and forces the lamp control output to +12 volts using transistor Q4. Internally, the circuitry up to and including U1-B continues to process intensity signals, and their levels can be interrogated. The ON command reconnects the lamp control voltage output to the output of amplifier U1-B.

B. Operating Modes

The "AMx" and "DMx" commands (where $0 \leqq x \leqq =1$) disable/enable the digital and analog modes, respectively. Enabling analog mode entails turning on analog switches U2-A and U2-B, which route the analog photosensor voltage to the lamp control voltage output. Digital mode operates when the system software programs PWM channel 1 with values dictated by the output of the Digital I/O Table at the PWM update frequency.

When AM=0 and DM=0, microprocessor control unit 14 operates in open loop mode, with its output controlled only by setting of PWM channel 1. This is the power-on default operating mode. When AM=0 and DM=0, microprocessor control unit 14 operates in analog mode. When AM=0 and DM=1, microprocessor control unit 14 operates in digital mode, with the output signal on PWM channel 1 determined by the digital I/O table as described above. When AM=1 and DM=1, microprocessor control unit 14 operates in mixed mode, in which its output voltage is the sum of the input analog signal plus the digital I/O table output value.

C. Digital Mode Response Limiters

The "DD=x" and "DR=y" commands (where $0 \leqq x \leqq 48000$; $0 \leqq y \leqq 255$) respectively control the rate at which values output by microprocessor control unit 14 are updated, and the rate of change of such values. More particularly, the "DD=x" command fixes the delay time between successive updates of the signal output by microprocessor control unit 14, when operating in digital mode. The delay is specified in terms of PWM updates, which normally occur 800 times a second under software control, as specified by PWM frequency parameters stored in microprocessor 22's EEPROM memory. Thus, the command "DD=48000" specifies a 60 second delay between successive updates.

The "DR=y" command limits the rate at which the digital mode output channel moves toward a new output value. For example, the command "DR=255" sets the output to the value dictated by the digital I/O table without regard to the previous setting; and, the command "DR=128" sets the output halfway between the previous setting and the result from the I/O table. In general, the higher the DR value, the more rapidly the output will approach the I/O table setting, as explained below.

Two methods of limiting are provided to tune the response of a digital mode feedback system. The first limiting parameter is Digital Delay limiting: instead of using the digital I/O table to update the output with every PWM update (800 times per second), the DD parameter instructs the software to wait a given number of PWM updates before changing the digital mode output. This can be used to allow an external device to stabilize if it has a poor response to control voltage changes. The DD parameter can be as high as 48000, causing updates to occur only once per minute. The default value is zero.

The second parameter is Digital Rate limiting, which allows the output to take the previous output level into account in determining a new output. The DR parameter determines the magnitude of the step taken in changing the digital mode output to a new value, within a range from 0 to 255. A value of 255 means the full range is stepped over at once. By reducing the DR parameter to 127, for example (127 is half of 255), the system steps only half way from the previous output value to the new value, as determined by the digital I/O table. The next output update (which can be delayed by DD) would be stepped half way between the step just described and the destination, and would continue taking increasingly smaller half-steps until gradually reaching the target value. This assumes no feedback. Normally, the controlled device would be responding to the changes, and the feedback loop would balance at an intermediate step.

D. Digital Input/Output Channels The "DI=x", "DI?", "DO=y" and "DO?" commands (where $0 \leqq x \leqq 3$; $0 \leqq y \leqq 2$) control selection of input and output channels in the operation of the digital mode (as enabled by DM1, disabled by DM0) of microprocessor control unit 14. In particular, the "DI=x" command selects one of four A/D input channels as the input to the digital I/O table: the table output is directed to the channel selected as DO as explained below. Channel 0 is the default selection. The "DI?" command retrieves the current digital input channel number. Microprocessor control unit 14 responds to the "DI?" command via its RS-232 interface by sending the ASCII channel number. The "DI?" command is typically used to verify that the desired A/D input channel has been selected for input to the Digital I/O Table. The "DO=y" command directs the digital mode output values from the I/O table to the selected PWM output channel. The default channel is 1. The "DO?" command retrieves an identification of the current output channel selection in the manner explained above for the "DI?" command, allowing the user to verify selection of the desired output channel. The following sequence of commands and responses illustrates usage of the foregoing commands (the user's input is underlined):

| Command/Response | Comment |
|---|---|
| >DI = 0 | select A/D channel 0 as input to Digital I/O Table |
| >DO = 1 | select PWM channel 1 to receive Digital I/O Table output values |
| >DI? | what A/D channel is currently selected? |
| 0 | system responds: A/D channel 0 selected |
| >DO? | what PWM channel is currently selected? |
| 1 | system responds: PWM channel 1 selected |

E. Voltage Input

The "VIx?" command (where $0 \leqq x \leqq 3$) is used to read a value from A/D converter channel x, such value being in the range of 0 (0 volts) to 255 (5 volts).

F. Voltage Output

The "VOx=y" command (where $0 \leqq x \leqq 2$; $0 \leqq y \leqq 255$) programs pulse-width modulator (PWM) channel x with value y, subject to the window limits discussed below. The "VOx?" command (where $0 \leqq x \leqq 2$) reads the current value programmed into PWM channel x, regardless of the window limits (i.e. reading range matches full output range).

When a PWM output channel is programmed with a given value, the microprocessor pin associated with that channel is programmed to oscillate at the PWM master frequency of 800 Hz. The duty cycle (the proportion of the total cycle length for which the output is at +5 volts) for each signal is negatively proportional to the programmed output value. For example, if 0 is selected, the output is at +5 volts for 100% of the cycle time, declining towards 0% as the selected setting increases towards 255. Negation is required because each output has its logic level inverted by the three NAND buffers U101-B, C and D (FIG. 3(*b*)). The NAND buffers feed into a resistor-capacitor (RC) filter which smooths the PWM signal into an analog voltage. Inversion of the buffers results in a 0 analog voltage for a 0 setting, with the analog voltage increasing towards +5 volts linearly with increasing settings.

G. Voltage Output Resolution Enhancement

The commands "VHx=y", "VHx?", "VLx=y" and "VLx?" (where $0 \leqq x \leqq 2$; $0 \leqq y \leqq 255$) determine window limits as described below. In particular, the command "VHx=y" programs a high-end window limit on PWM channel x; the command "VHx?" reads back the current high-end window limit on channel x; the command "VLx=y" programs the low-end window limit on PWM channel x; and, the command "VLx?" reads back the current low-end window limit on channel x.

The range of output values specified by user's command (0–255) are of lower resolution than is available from the PWM channels, which internally default to a range of values from 0 to 2350. To make this extra resolution available, capacity for creation of a subrange "window" in the 0–255 command range is provided, in which case the VOx=y commands work only within that window. For example, to maintain the photosensor bias voltage between 1 and 3 volts, instead of 0 to 5 volts, the following commands would be issued:

>VL0=51 (sets low end of PWM0 window to 1 volt)

>VH0=153 (sets high end of window to 3 volts) After execution of these commands, setting VO0=0 would actually set PWM channel 0 to 1 volt, and VO0=255 would set the output to 3 volts.

The VOx? command returns the absolute PWM setting, scaled in the 0–255 range. In the above example, if VO0=0 is selected, VO0? would return 51, not 0, since 51 is the value of the bottom end of the window. Similarly, after VO0=255, VO0? would return 153. Setting window limits closer than 9 values apart is unrewarding, since narrower windows will not provide any further improvements in resolution.

H. Digital I/O Table Load, Save and Edit

The commands "TLX", "TS", "TVy=z" and "TVy?" (where $0 \leqq x \leqq 2$, $0 \leqq y \& z \leqq 255$) facilitate operations on the digital I/O table. In particular, the command "TLx" loads the table as follows: "TLO" loads a "null" table (i.e. all output values are zero); "TL1" loads a "linear" table (i.e. output value=input value); and, "TL2" loads a user-defined table obtained from microprocessor control unit 14's EEPROM memory. The command "TS" saves the current table as a user-defined table, and also saves the current digital input and output channels (see "DI=x" and "DO=y" commands above) as power-on default values. The "TVy=z" command changes the current table such that input value y generates output value z. The "TVy?" command reports the current output value programmed in the currently active table for input value y.

I. System Reset and Reload

The "reset" command, which is for diagnostic use only, causes microprocessor 22 to perform a self-reset, reinitializing all parameters to their power-on default values. The "reload" command, which is also for diagnostic use only, reinitializes microprocessor 22's EEPROM memory to the default values transferred from EPROM memory when microprocessor 22 is originally installed in microprocessor control unit 14. These commands should not be used while microprocessor control unit 14 is regulating operation of lamp 10.

J. EEPROM Programming

Microprocessor 22's non-volatile EEPROM memory is used to store configuration parameters and power-on defaults. The command "Ex=y" (where $32256 \leqq x < 32768$, and $0 \leqq y \leqq 255$) programs EEPROM location x with data value y; the command "Ex?" interrogates location x for current data. The following data values are stored in microprocessor 22's EEPROM memory:

| Address | Contents |
|---|---|
| 32256 | EEPROM checksum high byte |
| 32257 | EEPROM checksum low byte |
| 32258 | EPROM checksum high byte |
| 32259 | EPROM checksum low byte |
| 32260 | PWM period high byte |
| 32261 | PWM period low byte |
| 32262 | PWM margin high byte |
| 32263 | PWM margin low byte |
| 32264 | PWM channel 0 default value at reset |
| 32265 | PWM channel 1 default value at reset |
| 32266–7 | reserved for PWM channels 2–3 |
| 32268 | Digital mode table input channel at reset |
| 32269 | Digital mode table output channel at reset |
| 32270–525 | User-defined Digital input/output table |
| 32526 | Default mode at reset: 0 = open-loop, 1 = analog 2 = digital, 3 = mixed |
| 32527 | Compatibility byte: triggers version upgrade |
| 32528–531 | Resolution enhancement low window table |
| 32532–535 | Resolution enhancement high window table |
| 32536–537 | Default digital delay value |
| 32538 | Default digital tracking rate value |

V. Software Pulse-Width Modulation

Pulse-Width Modulation (PWM) is a well known method of generating an analog voltage using a digital output (i.e. one having two possible output levels: ON or OFF). The technique toggles the output at a fixed rate. The ON voltage level and the ratio of the ON time to the sum of ON and OFF times determines the analog voltage.

Microprocessor control unit 14 uses microprocessor 22's multiple-channel timer to generate the three PWM output channels (described above) having an 800 Hz master frequency. The master frequency can be changed by altering the "PWM period" value stored in microprocessor 22's EEPROM memory. The PWM period is measured in microprocessor clock cycles, each of which is 0.5 microseconds long. An 800 Hz signal has a period of 0.00125 seconds, or 1250 microseconds, which is 2500 clock cycles. The clock cycle value (i.e. 2500 in this example) is converted into two bytes for storage, by dividing it by 256. The integer result (9) is stored in the high byte, and the remainder (196) is stored in the low byte.

The software uses a "double-buffer" method of loading PWM period values, whether such commands originate via a "VOx=y" user command, or are generated automatically via the Digital I/O Table while digital mode is enabled by the "DM1" command. The user specifies a value of 0 to 255, which is divided by 256 to form a fraction which is always less than 1. This fraction is multiplied by the PWM period to determine the desired ON duration of the PWM signal output by microprocessor control unit 14. The result is stored in a register, but does not become effective until the currently active PWM cycle has finished. This creates a small lag in response, but should be negligible compared to the response delay that would result if the output were instead filtered to create an analog signal.

A PWM period value of zero (the lowest possible value) results in no signal output by microprocessor control unit 14. However, the highest possible value (255) does not result in continuous signal output. This is due to the divide-by-256 fraction, and due to a "PWM margin" value, which is a small portion of the total PWM output period reserved for the processing overhead needed to maintain glitch-free PWM output. The PWM margin value defaults to 100 clock cycles (50 microseconds), and is stored in microprocessor 22's EEPROM memory.

The PWM output drive is interrupt-driven and operates transparently to the user (that is, it appears to be an autonomous function in normal operation). There are situations which can cause unusual operation: FATAL errors, software crashes and user resets. Each of these affects the way the timer operates, and thus affects the PWM outputs since they are derived from the system timer. Specifically, software crashes (when microprocessor 22 stops executing code properly) prevent normal updating of the timers to maintain the proper PWM signal, causing incorrect voltages to appear at the outputs. User resets and FATAL errors force the PWM output voltages to full scale, normally causing a lamp to be dimmed to minimum intensity. This condition will be momentary for user resets, but intervention will be required to restore normal operation after a software crash or FATAL error.

In operation, the filtered analog voltage from the pulse-width modulators, located at the junctions of R105 and C105 (channel 0), R106 and C106 (channel 1), and R107 and C107 (channel 2), contains a small amount of "ripple" due to background variation in the voltage that has the same frequency as the modulator. The ripple can be reduced by filtering the signal, but at a cost of slowing the response of the analog output. There is more ripple in analog mode than in digital mode because ripple in the Bias voltage regulated across the photosensor is amplified and sent forward into both the analog and digital drive stages. However, the digital mode input is sampled synchronously with the PWM master clock, thereby removing the effects of the ripple in digital mode. Under normal conditions the ripple frequency is too high to affect the operation of a lamp power supply and can be safely disregarded.

VI. Monitoring System Operation

The "All's Well" signal in the microprocessor-controlled system is generated identically to its analog counterpart. The meaning is slightly different, however. Conventionally, the "All's Well" signal means "the feedback system is regulating", but it now means "the feedback system is capable of regulating". The difference takes open-loop mode into account (neither analog nor digital modes active). In open-loop mode, the lamp control voltage output does not respond to changes on the photosensor input, so input levels may be sufficient to activate the "All's Well" output without having the feedback system perform regulation.

As previously indicated, the microprocessor's signal monitoring allows more sophisticated diagnostics than the simple "All's Well" signal. When the system is properly regulating, the voltage across photosensor 18 (which can be interrogated using the command "VI2?") is maintained at the same voltage as the user-defined Bias voltage (set with the "VO0=y" command, and interrogated with the "VI1?" command). Thus, a balanced feedback loop will keep the values reported by "VI1?" and "VI2?" close to the same. A small margin is allowed since these two values are read at different times.

If there is insufficient light, the resistance of photosensor 18 will be too high: under this condition, there will be insufficient current loading by photosensor 18 to lower the voltage across the sensor to the Bias voltage. The passive current bias provided through resistor R2 (FIG. 3(*c*)) ensures this, and the output of U2-B will drop to near zero volts (its minimum level) in an attempt to reduce the voltage across photosensor 18. Monitoring the photosensor voltage (via command: VI2?) yields a result significantly larger than the Bias voltage (command: VI1?).

If light levels are excessive or the system gain control (VR1) is set too high, "VI2?" will return a value lower than "VI1?". This is because the photosensor's resistance is so low that the feedback loop cannot supply enough current to raise the voltage across the sensor to the Bias voltage. Such a situation can be further confirmed by reading the analog lamp drive voltage (command: "VI0?"). Results consistently at or near 255 also mean that the input is overdriven and the gain setting must be reduced for linear operation.

It is normal to see the Bias voltage value returned using the command "VI1?" read lower than the value programmed on the Bias PWM channel using "VO0=x". This is because PWM channels must allow a small margin (described earlier) to prevent a PWM output setting of 255 from reaching the full 100% output duty cycle. The scaling difference is 4%, such that the "VI1?" command returns a value 4% lower than the "x" value set with "VO0=x". This can be verified by setting VO0=100, then using the "VI1?" command to see a return value consistently close to 96. The difference does not interfere with normal operation and indicates no malfunction.

As previously mentioned, microprocessor control unit 14 is capable of providing more detailed diagnostic information in comparison to the simple "All's Well" signal provided by prior art controllers. For example, if HID lamp 10 produces insufficient light, the voltage across photosensor unit 18 will be too high. By monitoring that voltage with the aid of the VI2? command one may yield a result significantly larger than the bias voltage (command: VI1?). A small margin must be allowed for the fact that these two values will have been taken at different times. Similarly, finding VI2 lower than VI1, especially if the analog lamp drive voltage (command: VI0?) results in a number at or near 255, means that the input is over-driven and the GAIN setting must be reduced for linear operation.

VII. Diagnostics

The system software contains a number of self-diagnostic routines for detecting faults and failures. If a situation is detected which could result in improper operation, a fatal error (FIG. 4(*f*)) is declared, triggering a shutdown of microprocessor control unit 14. In this situation, all input/output operations terminate and the word "FATAL" is transmitted over the RS-232 communications line. An ASCII BEL character is also sent, to sound the bell or buzzer on terminals so equipped.

After a fatal error occurs, an exclamation mark ("!") received over the RS-232 communications line causes transmission of a description of the fatal error, followed by the message ">SYSTEM SHUT DOWN <".

Some fatal errors caused by failed memory tests have context-sensitive recovery routines which allow the user to observe and possibly correct the situation which caused the error. Recovery routines respond if a carriage return (eg. return or enter key, ASCII value 13) is received from the user after the ">SYSTEM SHUT DOWN <" message is sent.

The following errors are considered fatal: "Illegal Opcode", "Bad CONFIG Register", "RAM Test Failed", "EEPROM Test Failed", "EPROM Test Failed", "Stack Overrun", and "EEPROM Write Verify Fail".

The "Illegal Opcode" error occurs if microprocessor 22 attempts to execute an undefined instruction. Usually this means that the address or data signals input to microprocessor 22 have been disrupted. The user may initiate the recovery routine in EPROM, as described above, to display the address at which the error occurred and the data which is read, but the system must be reset by cycling power off and on before operation can resume.

The "CONFIG Register" (located within microprocessor 22) defines the microprocessor's operating mode, which should never change. The CONFIG register's contents are compared with the expected value at reset, and if the values fail to match, the "Bad CONFIG Register" error occurs. The recovery routine attempts to reprogram the CONFIG register.

The entire RAM memory is tested extensively at reset (FIG. 4(*a*)). Any failure results in the "RAM Test Failed" Fatal error. The recovery routine displays the failed address, but control unit 14 must be powered off and on again to restart the system. Should the error occur again, microprocessor 22 (which includes the RAM memory internally) must be replaced.

User-configurable values are stored in EEPROM memory (also internal to microprocessor 22), as previously explained. To ensure that EEPROM memory cells are not accidentally changed, a checksum is maintained in a pair of EEPROM bytes, and updated whenever the contents of any other EEPROM cell(s) are changed under valid program control. This test verifies the memory against the sum and offers three choices upon failure: ignore, reload, or force. "Ignore" allows the control unit 14 to continue operating despite the discrepancy, allowing the user to track down the source of the error. "Reload" resets the EEPROM memory cell contents to their default values, resulting in loss of any user-configured values. "Force" adjusts the checksum to match the EEPROM's current state, (as also occurs after "Ignore", if any EEPROM memory cell is updated).

The software used to control operation of microprocessor control unit 14 is stored in EPROM 24, which is tested at reset for a checksum. The checksum is compared to a pre-tested reference value stored in microprocessor 22's EEPROM memory. The "EPROM Test Failed" Fatal error occurs if the comparison indicates that the EPROM's contents have changed. The recovery routine offers the choice of Ignoring the error or Forcing the EEPROM value to agree with the current EPROM checksum value.

The "stack" is an area of memory used by the software for temporary storage as needed. If the stack use exceeds its allocated space, the "Stack Overrun" error occurs. Since a stack overrun always means that information has been lost, no meaningful recovery is possible. Control unit 14 must be reset by powering it off and on again to restart the system.

After data is written into any EEPROM memory cell that cell is checked to verify retention of the new data. Immediately after the new data is written into the cell, the contents of that cell are read back and compared with the previously written value. The "EEPROM Write Verify Fail" error occurs if the comparison reveals that the two values are different. This error stops operation of microprocessor control unit 14. Again, no recovery is possible and the control unit must be reset.

VIII. Colour control through wattage regulation

The invention also provides a colour photosensor circuit which permits microprocessor control unit 14 to regulate the colour of metal halide lamp 10. The circuit is stable, inexpensive, and is highly immune to both noise and long term drift.

As FIG. 1 shows, the regulation of HID lamp wattage through the application of a control signal to power supply 12 will result in a range of lamp correlated colour temperatures. If the upper end of the wattage range is utilized, then it is possible to achieve colour matching within a large population of metal halide lamps without significantly affecting the average light output within the space illuminated by the lamps. By controlling individual lamps, one may control colour variation between different lamps and ensure that such variations remain within acceptable limits throughout the useful life of each lamp. If microprocessor control unit 14 determines that a particular lamp can not be satisfactorily controlled, then the operator is signalled via a message sent to PC 16 so that appropriate alternative action can be taken. Similar messages are sent to PC 16 if microprocessor control unit 14 determines that a particular lamp or lamps are exhibiting age-induced colour variations exceeding acceptable limits.

HID lamp 10 exhibits a well defined range of colour temperatures as its wattage is varied. It is accordingly possible to derive a signal proportional to colour temperature change for use by microprocessor control unit 14.

Typical prior art colour meters are based on an expensive tristimulus architecture. By contrast, the invention provides an inexpensive colour photosensor circuit which suffices for proportional colour control of a relatively linear colour envelope as seen in FIG. 1. The circuit accordingly facilitates active feedback colour control without the expense and complexity of a tristimulus metering system. Besides being well suited to use in maintaining lamp-to-lamp colour consistency in HID lighting systems, the colour photosensor circuit may be used in photoreproductive processes where colour consistency is critical. Further, by placing a spectral filter in the path of one of a pair of silicon photodiodes, one may tailor the circuit's output to provide a feedback signal to which microprocessor control unit 14 can respond while operating in its aforementioned digital mode.

IX. Colour Photosensor Circuit Description

The colour photosensor circuit (FIG. 5) provides a DC voltage output signal representative of the colour temperature of light incident on photodiodes D1, D2. Accordingly, the circuit must compensate for changes in the intensity of the incident light, and be resistant to spurious output changes caused by temperature shifts.

The circuit consists of an upper "intensity" channel comprising photodiode D1, amplifiers U1-A, U1-B, MOSFET transistor Q1, zener diode Zi, diodes D1–D3 and transistors Q3, Q4; and, a lower "colour" channel comprising photodiode D2, amplifiers U1-D, U1-C and MOSFET transistor Q11.

In the intensity channel, the output signal produced by photodiode D1 is input to amplifier U1-A, which produces a voltage signal representative of the photodiode's output current. Amplifier U1-B amplifies the voltage signal output by amplifier U1-A. MOSFET transistor Q1 acts as a "feedback shunt" to implement variable gain. In the colour channel, colour filter 30 positioned in front of photodiode D2 selectively filters incident light so that the colour channel "sees" only a selected portion of the spectrum relative to the intensity channel. As an HID lamp changes colour temperature with changes in arc power, the balance across the spectrum is shifted. For example, in the case of metal halide lamps with typical sodium-scandium chemistry, as power is increased, there is a corresponding increase in the red end of the spectrum, which effectively lowers the colour temperature of the lamp. Amplifier pair U1-D, U1-C coupled to the output of photodiode D2 is identical to amplifier pair U1-A, U1-B with MOSFET transistor Q11 providing for variable gain.

The output of amplifier U1-B is fed to transistor pair Q3, Q4 which acts as a comparator. If the voltage output of amplifier U1-B exceeds the voltage of zener diode Z1 (+5 volts DC) then Q3 turns off, which in turn turns off Q4, removing gate drive from the MOSFETs Q1 and Q11. As the MOSFETs turn off, more feedback reaches the amplifiers, effectively reducing their gain until the output of amplifier U1-B returns to the threshold of Q3 turn-on. Similarly, if the voltage output of amplifier U1-B is too low, Q3 and Q4 turn on and drive the MOSFET gates, which divert the feedback signals from the amplifiers and enhance their gain. Because the MOSFETs act as variable resistors and are matched by variable resistors located in each channel, the colour channel is subjected to the same gain setting as the intensity channel. Therefore, the colour channel's output is between 0 and +5 volts DC, dependent only on the amount of light striking filtered photodiode D2, relative to the light striking unfiltered photodiode D1.

The FIG. 5 dual channel amplifier circuit is inferentially drift-insensitive: since both channels are identical and physically close to each other, any thermal drift or drift with time will be cancelled by the automatic gain control in the intensity channel. Temperature drift in the comparator transistor circuit is countered by the diodes D1–D3 coupled to zener reference diode Z1.

The circuit lacks the ability to compensate for overdrive. However, this can easily be detected because, in an overdrive condition, the intensity channel's output will exceed +5 volts DC, and the comparator's output will slew to the lowest possible level in an attempt to turn off the feedback-shunting MOSFETs.

The circuit is initially calibrated by adjusting variable resistors in each channel to minimize DC voltage between the respective outputs of amplifiers U1-B and U1-C, while photodiodes D1, D2 are equally illuminated with colour filter 30 removed. This sets the full-scale response, while the zero level is inherent in the design.

The colour photosensor circuit of FIG. 5 can also provide a raw indication of intensity if colour feedback is not desired. For example, one may tap the unconditioned signal from the input of the automatic gain amplifier. This signal is linearly proportional to intensity.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. Apparatus for controlling the operation of one or more high intensity discharge lamps, each of said lamps having a photosensor associated therewith, said apparatus comprising:

(a) an electronic high intensity discharge lamp power supply electrically connected to a power source and to said one or more high intensity discharge lamps;

(b) each of said photosensors for producing an output signal representative of colour temperature in light output by said respective lamps, each of said photosensors further comprising first and second photodiodes, and a colour filter mountable between said second photodiode and said lamp associated with said photosensor;

(c) a controller electrically connected between each of said photosensors and said power supply, said controller for receiving said output signals representative of colour temperature and for outputting power supply control signals for controlling operation of said one or more lamps to maintain a desired uniformity of colour temperature variation in light output by said one or more lamps;

(d) for each lamp, colour signal feedback means electrically coupled between said first and second photodiodes and said controller, said colour signal feedback means for producing a signal representative of colour temperature variation, said colour signal feedback means further comprising:

(i) a first variable gain amplifier electrically connected to said first photodiode for input to said first amplifier of a first signal output by said first photodiode in response to light intensity output by said lamp;

(ii) a second variable gain amplifier electrically connected to said second photodiode for input to said second amplifier of a second signal output by said second photodiode in response to colour temperature of light output by said lamp; and, (iii) comparator means electrically connected to receive signals output by one of said amplifiers, to compare said amplifier output signals with a voltage reference signal and to output to each of said amplifiers a feedback signal for gain control of each of said amplifiers.

* * * * *

UNITED STATES PATENT AND TRADEMARK OFFICE

CERTIFICATE OF CORRECTION

PATENT NO : 5,828,178

DATED : 27 October, 1998

INVENTOR(S): Allan Brent York and Robert H. Maxwell

It is certified that error appears in the above-identified patent and that said Letters Patent is hereby corrected as shown below:

On the cover page , amend the title (item [54]) to read --High Intensity Discharge Lamp Color Controller--.

Column 1, lines 2-3, amend the title to read --High Intensity Discharge Lamp Color Controller--.

Signed and Sealed this

Thirtieth Day of March, 1999

*Attest:*

*Attesting Officer*

Q. TODD DICKINSON

*Acting Commissioner of Patents and Trademarks*